US007319472B2

(12) United States Patent
Inoue

(10) Patent No.: US 7,319,472 B2
(45) Date of Patent: Jan. 15, 2008

(54) PRINTER AND PRINTING METHOD

(75) Inventor: Hajime Inoue, Saitama (JP)

(73) Assignee: FUJIFILM Corporation, Tokyo (JP)

( * ) Notice: Subject to any disclaimer, the term of this patent is extended or adjusted under 35 U.S.C. 154(b) by 506 days.

(21) Appl. No.: 11/052,822

(22) Filed: Feb. 9, 2005

(65) Prior Publication Data

US 2005/0174383 A1 Aug. 11, 2005

(30) Foreign Application Priority Data

Feb. 9, 2004 (JP) ..... 2004-032417

(51) Int. Cl.
*B41J 11/00* (2006.01)

(52) U.S. Cl. ..... 347/175

(58) Field of Classification Search ..... 347/173, 347/175, 180–182, 171, 185, 190–191, 194–197, 347/211, 213, 215, 218; 400/615.2, 120.01–120.03, 400/120.07, 120.11, 120.14, 120.15
See application file for complete search history.

(56) References Cited

U.S. PATENT DOCUMENTS 5,724,085 A * 3/1998 Inui et al. ..... 347/175
5,847,742 A 12/1998 Nishimura
6,738,085 B2 * 5/2004 Hachinoda ..... 347/171
7,038,704 B2 * 5/2006 Hosokawa et al. ..... 347/191

* cited by examiner

*Primary Examiner*—K. Feggins
(74) *Attorney, Agent, or Firm*—Sughrue Mion, PLLC

(57) ABSTRACT

A direct color thermal printer includes a heating element array for yellow, a heating element array for magenta, and a heating element array for cyan to perform the thermal printing on each of recording areas in color thermosensitive recording paper. When one of the heating element arrays, the heating element array for yellow, for instance, faces a blank area of the color thermosensitive recording paper, the heating element array for yellow starts a blank area recording to thermally print the blank area. Thereby, all of the heating element arrays constantly remain in a state of thermal printing, so that variations in recording density, which is caused by the load fluctuations in the power supply, does not occur.

24 Claims, 12 Drawing Sheets

PRINTER AND PRINTING METHOD

BACKGROUND OF THE INVENTION

1. Field of the Invention

The present invention relates to a printer and a printing method using a plurality of print heads for sequentially recording a plurality of frames on a continuous recording material.

2. Background Arts

There are various types of color printers, e.g. ink jet printers, thermal wax transfer printers, thermal dye sublimation printers, and direct color thermal printers. The ink jet printer records color images by ejecting ink on a recording material by a print head. The thermal wax transfer printer and the thermal dye sublimation printer overlay an ink ribbon on the recording material and transfer the ink to the recording material by heating the ink ribbon by a thermal head (a print head). The direct color thermal printer performs recording by heating color thermosensitive recording paper formed of overlaid thermosensitive coloring layers, each of which develops different color, by the thermal head.

There are a multi-pass one-head type color printer and a one-pass multi-head type color printer. The one-pass multi-head type color printer has an advantage in that a shorter time is required for recording the color images. In the one-pass multi-head type color printer, a plurality of print heads are disposed along a feeding passage of the recording material, and each print head records the recording material in a different color to print the color image while feeding the recording material. The one-pass multi-head type color printer uses a continuous recording material and sequentially records a plurality of images along a lengthwise direction of the recording material. A blank area, which corresponds to an interval between a feed roller pair and the thermal head, is created between the areas (referred to as recording areas) in which the images are recorded. The blank area is a non-image area which is cut away from the recording area and discarded upon completion of the recording. The blank area may be left unprinted, or may have the images which protrude from the recording area in front of or behind it.

The print head of the color printer consumes a large amount of power. Therefore, there is a significant difference in the amount of power consumption of the one-pass multi-head type color printer between when one print head is operated and when a plurality of print heads are concurrently operated. As a result, a load in the power source circuit of the color printer fluctuates by a large amount. When the load in the power source circuit fluctuates, output voltage and output current amount also fluctuates. Such fluctuations change driving condition of the print head, so that recording density of the print head is varied.

When the recording density varies, unexpected density variation appears in a color print, which reduces image quality. In order to prevent the reduction of printed image quality caused by the load fluctuations in the power source circuit, a color printer disclosed in, for instance, U.S. Pat. No. 5,847,742 (See FIG. 13) regulates each interval Lh1 between the print heads 70-72 to be a length Lp1 which is a sum of the length W1 of each recording area 74*a*-74*c* and the length W2 of a blank area 75 of the recording material 73. Thereby, the print heads 70-72 concurrently perform recording in the recording areas 74*a*-74*c* and concurrently face a blank area 75.

However, since there are a plurality of print heads, when the interval Lh1 between the print heads are set to be the sum of lengths of the recording area W1 and the blank area W2, the color printer becomes upsized, and a feeding distance of the recording material is extended. Consequently, there arises a problem that the printing speed is reduced.

Further, in cases where length of the recording area is changed, or printing is performed in a plurality of the recording areas with different lengths in one sequence, at least one of the plural print heads inevitably faces the blank area between the recording areas while the remaining print heads face the recording areas. Conventional color printers stop the printing operation of the print head which faces the blank area. Therefore, the recording density varies according to the load fluctuations in the power source circuit. Such problems can be solved by using a power source circuit which is not affected by a change in the number of print heads in operation. However, another problem arises in that such power source circuit increases manufacturing costs of the color printer.

SUMMARY OF THE INVENTION

In view of the foregoing, it is an object of the present invention to provide a printer and a printing method for preventing reduction of image quality due to load fluctuations in a power source without increasing costs.

In order to achieve the above and other objects, the printing method of the present invention records color images in a plurality of recording areas line by line by driving a plurality of print heads arranged along a feeding passage while feeding a recording material from an upstream side to a downstream side along the feeding passage. A position information of a blank area, which is created between the recording areas, is detected with the feed of the recording material. According to the detected position information of the blank area, whether the blank area faces the print head or not is determined. When the blank area faces the print head, a recording energy for the blank area, which is for recording the blank area, is calculated. Then, the recording energy for the blank area is provided to the print head and recording is performed in the blank area.

The print head includes a plurality of recording elements which are disposed along a width direction of the recording material. The recording energy for the blank area is calculated on the basis of the recording energy supplied to the recording elements when the images are recorded in a preceding recording area, which is adjacent to the blank area on the downstream side of the feeding passage, and in a following recording area, which is adjacent to the blank area on the upstream side of the feeding passage. It is preferable to set each interval of the print heads shorter than a sum of lengths of a recording area and a blank area for the sake of downsizing the printer.

To calculate the recording energy for the blank area, a first average recording energy and a second average recording energy are calculated. The first average recording energy is an average value of recording energy which is provided to the recording elements while recording the images at a last recording line in the preceding recording area. The second average recording energy is an average value of recording energy which is provided to the recording elements while recording the images at a first recording line in the following recording area. The recording energy for the blank area is determined as a value which ranges between the first average recording energy and the second average recording energy.

Further, it is possible to determine the recording energy for the blank area as an average value of the first average recording energy and the second average recording energy. The recording energy for the blank area is gradually increased or decreased from the first average recording energy to the second average recording energy. It is also possible to obtain the recording energy for the blank area by first order approximation of the first average recording energy and the second average recording energy.

Further, it is possible to determine the recording energy for the blank area with respect to each recording element of the print head. In that case, the recording energy for the blank area is a value which ranges between a first recording energy for recording the image at the last recording line in the preceding recording area by the recording element and a second recording energy for recording the image at the first recording line in the following recording area by the recording element. Further, it is possible to determine the recording energy for the blank area as an average value of the first recording energy and the second recording energy. The recording energy for the blank area is gradually increased or decreased from the first recording energy to the second recording energy. Further, it is possible to obtain the recording energy for the blank area by the first order approximation of the first recording energy and the second recording energy.

The printer of the present invention includes a plurality of print heads, which are arranged along the feeding passage and prints color images by one line, a feeding position detecting section for detecting a position of the blank area created between the recording areas on the feeding passage, a recording energy calculating section for calculating the recording energy for the blank area for performing the recording in the blank area, and a print head driving section for driving the print head. The print head driving section provides the recording energy for the blank area to the print head when the blank area faces the print head.

The printing method and the printer of the present invention allow the print head, which faces the blank area, to perform the blank area recording, so that a significant load fluctuation of the power source is prevented and unexpected variations in recording density, which reduces image quality, does not occur.

BRIEF DESCRIPTION OF THE DRAWINGS

The above objects and advantages of the present invention will become apparent from the following detailed descriptions of the preferred embodiments when read in association with the ac companying drawings, which are given by way of illustration only and thus do not limit the present invention. In the drawings, the same reference numerals designate like or corresponding parts throughout the several views, and wherein.

DETAILED DESCRIPTION OF THE EMBODIMENTS

Figure 1:
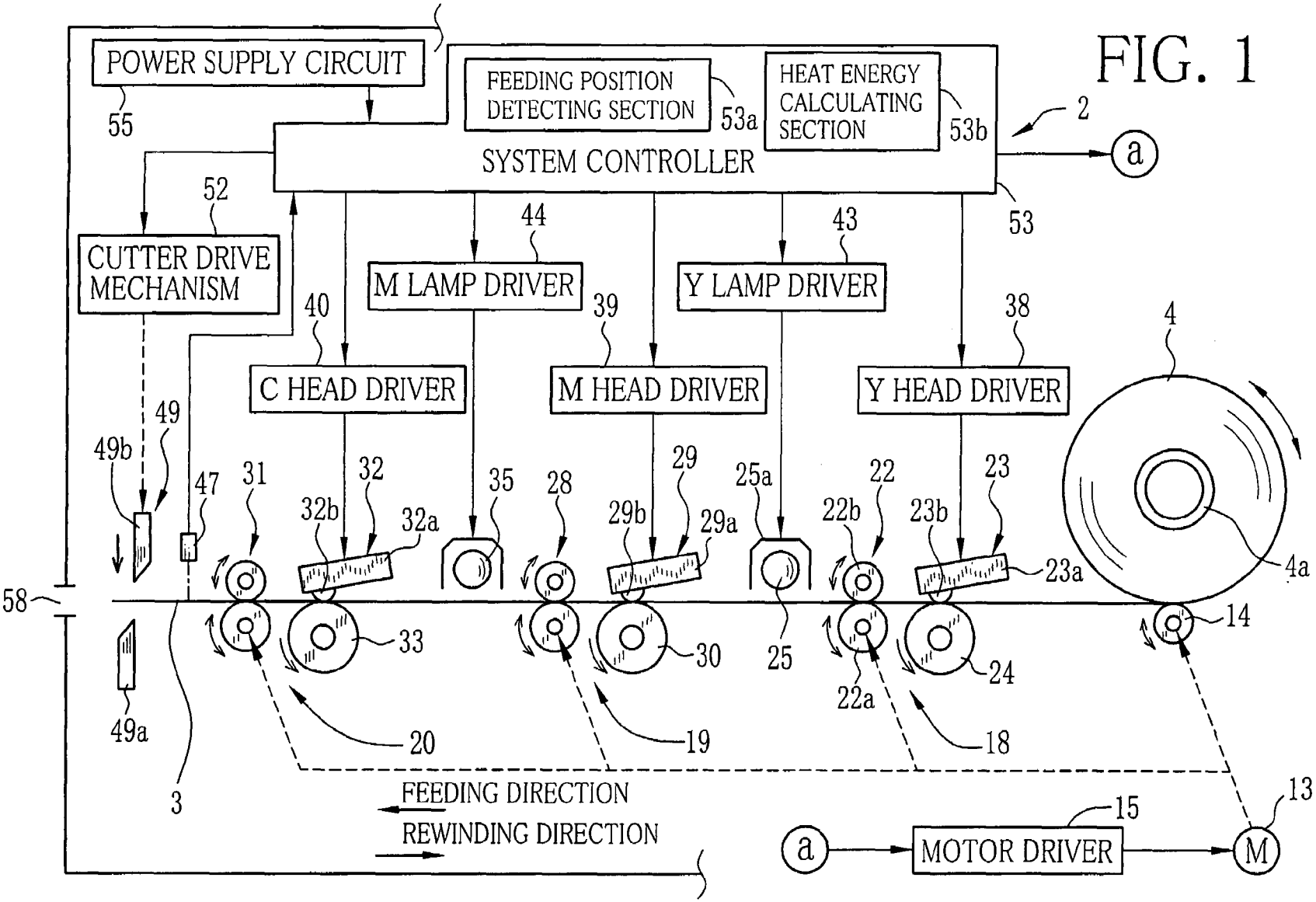
FIG. 1 is a schematic illustration showing a structure of a direct color thermal printer according to the present invention.

In FIG. 1, a direct color thermal printer 2 uses a continuous color thermosensitive recording paper 3 as a recording material. The color thermosensitive recording paper 3 is wound around a core 4*a* into a roll form to be a recording paper roll 4, which is set in the direct color thermal printer 2.

Figure 2:
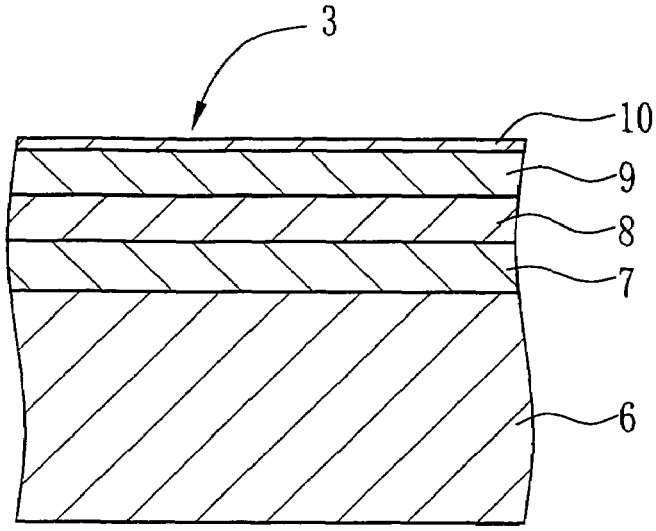
FIG. 2 is an explanatory view showing a layer configuration of a color thermosensitive recording paper.

As shown in FIG. 2, the color thermosensitive recording paper 3 is formed of a cyan thermosensitive coloring layer 7 to develop a cyan color, a magenta thermosensitive coloring layer 8 to develop a magenta color, a yellow thermosensitive coloring layer 9 to develop a yellow color and a protection layer 10 overlaid on a support 6 in this order.

Figure 3:
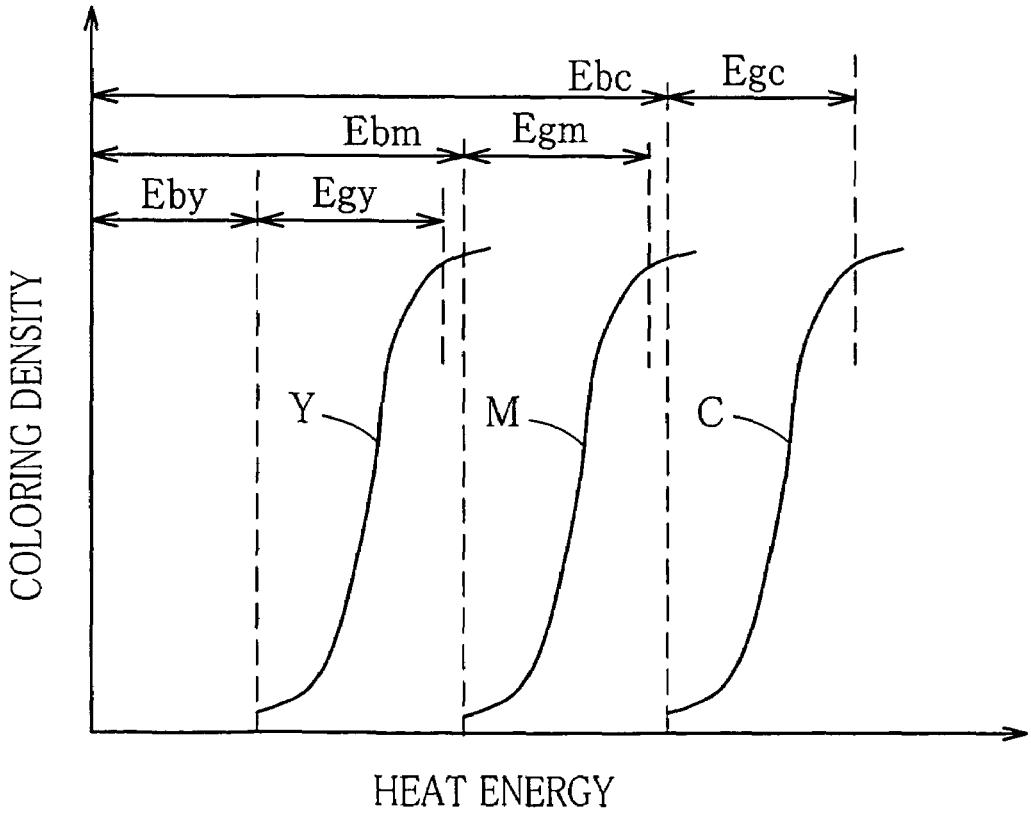
FIG. 3 is a graph showing coloring property of the color thermosensitive recording paper.

As shown in a graph of FIG. 3, the yellow thermosensitive coloring layer (Y) 9, which is the uppermost layer, has the highest heat sensitivity, and is developed by low thermal energy. The cyan thermosensitive coloring layer (C) 7, which is the lowermost layer, has the lowest heat sensitivity, and is developed by high thermal energy. The magenta thermosensitive coloring layer (M) 8 is developed by the intermediate thermal energy between the yellow and the cyan thermosensitive coloring layers 9 and 7.

When recording yellow pixels, a sum of a bias heat energy Eby for yellow and a gradation heat energy Egy for yellow is applied to the yellow thermosensitive coloring layer 9. The bias heat energy Eby is an energy just before developing the yellow thermosensitive coloring layer 9. The gradation heat energy Egy controls coloring density of pixels to be recorded, and is determined in accordance with a gradation level of the yellow image. Likewise, the bias heat energy and the gradation heat energy are applied to the magenta and cyan thermosensitive coloring layers respectively. Bias heat energy for the magenta thermosensitive coloring layer 8 and the cyan thermosensitive coloring layer 7 are designated as Ebm and Ebc respectively. Gradation heat energy for the magenta thermosensitive coloring layer 8 and the cyan thermosensitive coloring layer 7 are designated as Egm and Egc respectively.

The yellow and the magenta thermosensitive coloring layers 9 and 8 have an optical fixation property. The yellow thermosensitive coloring layer loses its coloring ability when irradiated by the near ultraviolet rays with the wavelength of 420 nm. The magenta thermosensitive coloring layer 8 loses its coloring ability when irradiated by the ultraviolet rays with the wavelength of 365 nm. The cyan thermosensitive coloring layer 7 does not have the optical fixation property, since its heat sensitivity is at a level which does not develop cyan color in normal conditions.

In FIG. 1, a roller 14, which is rotated by a feed motor 13, comes in contact with a rim of the recording paper roll 4.

The feed motor 13 is a pulse motor, which is driven by pulses input from a motor driver 15. When the roller 14 is rotated in the counter-clockwise direction, the recording paper roll 4 is rotated in the clockwise direction, so that the color thermosensitive recording paper 3 is advanced from the recording paper roll 4. On the contrary, when the roller 14 is rotated in the clockwise direction, the recording paper roll 4 is rotated in the counter-clockwise direction to rewind the color thermosensitive recording paper 3.

The color thermosensitive recording paper 3, which is advanced from the recording paper roll 4, is fed to a feeding passage disposed in a horizontal direction. A yellow recording section 18, a magenta recording section 19, and a cyan recording section 20 are provided on the feeding passage to thermally record images on respective thermosensitive coloring layers of the color thermosensitive recording paper 3. The yellow recording section 18 comprises a feed roller pair 22 for yellow, which holds and feeds the color thermosensitive recording paper 3, a thermal head 23 for yellow, which is pressed against the color thermosensitive recording paper 3 to thermally record the yellow images on the yellow thermosensitive coloring layer 9, a platen roller 24 for yellow, and a fixing lamp 25 for yellow which fixes the yellow thermosensitive coloring layer 9.

The feed roller pair 22 for yellow includes a capstan roller 22*a*, which is rotated by the feed motor 13, and a pinch roller 22*b*, which is pressed against the capstan roller 22*a*. The feed roller pair 22 for yellow feeds the color thermosensitive recording paper 3 in the feeding direction while printing, and in the rewinding direction after the printing.

The thermal head 23 for yellow includes a head substrate 23*a* and a heating element array 23*b*. The head substrate 23*a* is formed of ceramics, aluminas, or alumina ceramics. The heating element array 23*b* is provided below the head substrate 23*a*. The heating element array 23*b* has a plurality of heating elements 23*c*arranged in line along a main-scanning direction perpendicular to the feeding direction of the color thermosensitive recording paper 3 (see FIG. 4B).

The platen roller 24 is rotatable. In addition, the platen roller 24 is movable in up-and-down directions and is biased by a spring (not shown) so as to be pressed against the heating element array 23*b* of the thermal head 23. When feeding or ejecting the color thermosensitive recording paper 3, the platen roller 24 is moved in a downward direction by a shifting mechanism, such as a cam or a solenoid, to form a space between the platen roller 24 and the thermal head 23.

The fixing lamp 25 for yellow is a narrow rodlike near-ultraviolet lamp, which is disposed along the main-scanning direction and surrounded by reflectors 25*a*. After the thermal recording of the color thermosensitive recording paper 3, the fixing lamp 25 for yellow irradiates the near-ultraviolet ray, a luminous peak of which is approximately the wavelength of 420 nm, to the color thermosensitive recording paper 3 to destroy the coloring ability of the yellow thermosensitive coloring layer 9.

As with the yellow recording section 18, the magenta recording section 19 includes a feed roller pair 28 for magenta, a thermal head 29 for magenta, and a platen roller 30 for magenta. Likewise, the cyan recording section 20 includes a feed roller pair 31 for cyan, a thermal head 32 for cyan, and a platen roller 33 for cyan. The magenta recording section 19 also includes a fixing lamp 35 for magenta to destroy the coloring ability of the magenta thermosensitive coloring layer 8 by irradiating the near-ultraviolet ray, a luminous peak of which is approximately the wavelength of 365 nm.

In the above embodiment, the feed roller pairs 22, 28, and 31 are disposed in the respective recording sections 18, 19, and 20. However, it is possible to use, for instance, only the feed roller pair 31 of the cyan recording section 20 as a feeding means for the color thermosensitive recording paper 3. In that case, a follower roller, which is rotated according to feeding of the color thermosensitive recording paper 3, or a tension roller, which applies a proper amount of tension to the color thermosensitive recording paper 3, may be disposed in the yellow recording section 18 and the magenta recording section 19 respectively.

When printing the images on the color thermosensitive recording paper 3, the color thermosensitive recording paper 3 is interposed between the heating element arrays 23*b*, 29*b* and 32*b*, and the platen rollers 24, 30 and 33 respectively, while being fed by the feed roller pairs 22, 28 and 31, in the feeding direction. Respective heating elements in the heating element arrays 23*b*, 29*b* and 32*b* are heated according to drive data input to the head drivers 38-40, and develop each thermosensitive coloring layer 7-9 of the color thermosensitive recording paper 3. The platen rollers 24, 30 and 33, are rotated in accordance with the feeding of the color thermosensitive recording paper 3, and press the color thermosensitive recording paper 3 against the heating element arrays 23*b*, 29*b*, and 32*b*. The fixing lamp 25 for yellow and the fixing lamp 35 for magenta are illuminated by lamp drivers 43 and 44 respectively, and fix corresponding thermosensitive coloring layers which are thermally recorded.

An optical sensor 47 for detecting a front end of the color thermosensitive recording paper 3 is incorporated on a downstream side of the feeding direction of the feed roller pair 31 for cyan. A cutter 49, which cuts the color thermosensitive recording paper 3 in the width direction, is disposed on the downstream side of the optical sensor 47 in the feeding direction. The cutter 49 is formed of a stationary blade 49*a* and a movable blade 49*b*. The stationary blade 49*a* is fixed below the feeding passage. The movable blade 49*b* is disposed above the feeding passage. A cutter drive mechanism 52 allows the movable blade 49*b* to move in the up-and-down directions. The stationary blade 49*a* and the movable blade 49*b* nip and cut the color thermosensitive recording paper 3. Further, it is also possible not to incorporate the cutter 49 in the direct color thermal printer 2 so as to eject the thermally recorded color thermosensitive recording paper 3 in the continuous form. In that case, a user cuts the color thermosensitive recording paper 3 in a predetermined position to make a color print in a sheet form.

A system controller 53 controls each section of the direct color thermal printer 2. The system controller 53 includes, for instance, ROM, RAM, CPU, and the like. Control programs or control data are recorded in the ROM. The RAM temporarily records the control programs or control data loaded from the ROM. The CPU carries out various arithmetic processing based on the control programs. A power source circuit 55 provides power to each section of the direct color thermal printer 2 via the system controller 53.

Figure 4A:
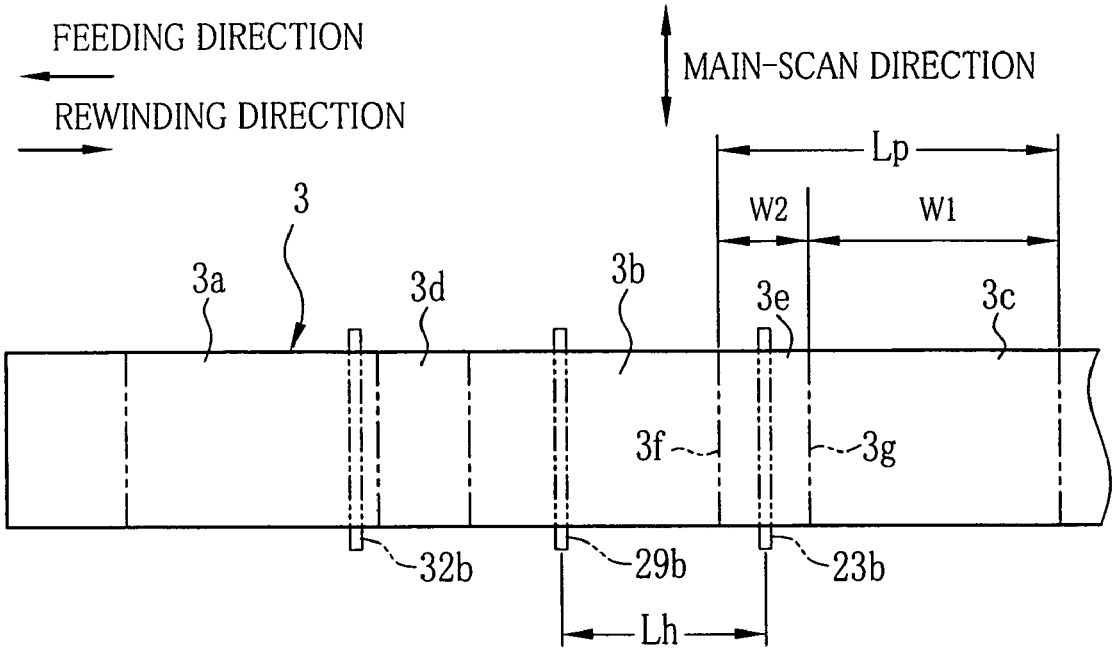
FIG. 4A is a plan view of the color thermosensitive recording paper in a feeding passage.
Figure 4B:
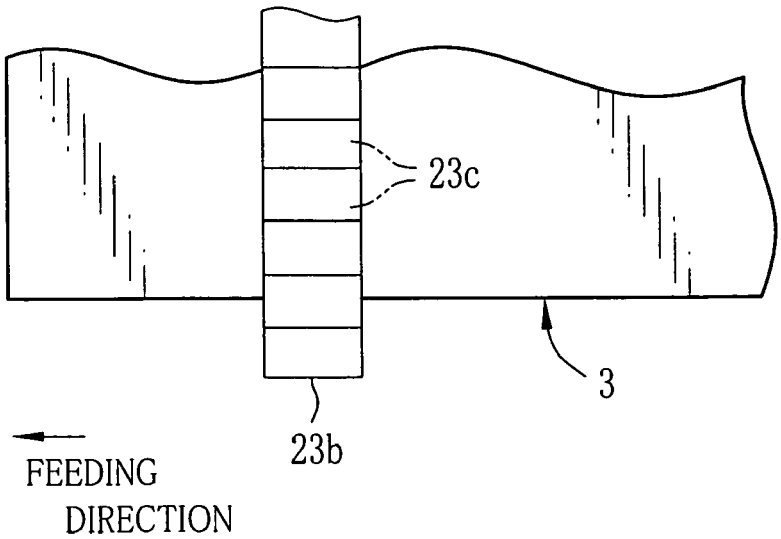
FIG. 4B is a partially magnified view of a print head.

In FIG. 4A, components shown by a chain double-dashed line along the main-scanning direction are the heating element arrays 23*b*, 29*b* and 32*b*, of the respective recording sections 18-20. The color thermosensitive recording paper 3 is divided into recording areas 3*a*-3*c*, in which images are recorded, and blank areas 3*d* and 3*e*, which are placed between the recording areas 3*a*-3*c*. Each blank areas, 3*d* and 3*e*, is a space for nipping, which corresponds to the intervals between the thermal heads 23, 29 and 32, and the feed roller pairs 22, 28 and 31. When the recording is completed, the blank area, which is a non-image area, is cut away from the recording areas 3*a*-3*c* and discarded.

As shown in FIG. 4A, an interval Lh between the heating element arrays is set to be shorter than a length Lp which is a sum of a length W1 of the recording area 3*c* and a length W2 of the blank area 3*e* of the color thermosensitive recording paper 3. Therefore, the color thermal printer 2 is downsized, and the feeding passage of the color thermosensitive recording paper 3 is shortened, so that it becomes possible to increase the printing speed. However, when the interval Lh between the heating element arrays is set to be shorter than the length Lp, three heating element arrays 23, 29 and 32 cannot concurrently face the recording areas. For instance, when the heating element array 29*b* of the magenta recording section 19 faces the first recording area 3*a*, and the heating element array 32*b* of the cyan recording section 20 faces the second recording area 3*b* for the thermal recording, then, the heating element array 23*b* of the yellow recording section 18 faces the blank area 3*e* which is between the second and the third recording areas 3*b* and 3*c*. The same problem arises when Lh is set to be longer than Lp.

In a conventional direct color thermal printer, a thermal head facing the blank area is shifted to a bias heating state which does not develop the blank area. As a result, the number of thermal heads, which perform the gradation heating concurrently, is decreased from three to two, so that the load in the power source circuit 55 is fluctuated. Accordingly, heating value of the thermal heads performing the gradation heating increases, which causes variations in recording density. Such variations in the recording density generate unevenness in the color prints, and reduce image quality.

The direct color thermal printer of the present invention is configured so as to set the thermal head, which faces the blank area of the color thermal recording paper, in a gradation heating state to perform a blank area recording which is to record the blank area. Further, the heat energy for the blank area recording is determined according to the heat energy of the last recording line in a preceding recording area, which is adjacent to the blank area on the downstream side of the feeding direction, and that of the first recording line in a following recording area, which is adjacent on the upstream side of the blank area. Thereby, the load fluctuations do not occur in the power source circuit 55, so that the unevenness due to the variations in the recording density can be prevented.

There is a printer which prints the image to slightly run off to the blank area in order to clearly print an edge portion of the image. Since the blank area is discarded after cutting, the blank area recording can be performed to the printed portion of the blank area without any problems.

The system controller 53 includes a feeding position detecting section 53*a* which detects positions of the recording areas and the blank areas of the color thermosensitive recording paper 3 in the feeding passage by counting the number of pulses supplied to the feed motor 13 after a front end of the color thermosensitive recording paper 3 is detected by the optical sensor 47. Further, the system controller 53 includes a head driving section and a heat energy calculating section 53*b*. The head driving section controls each head driver 38-40 to allow the thermal head, which faces the blank area, to perform the blank area recording. The heat energy calculating section 53*b* calculates the heat energy for the blank area.

Figure 5:
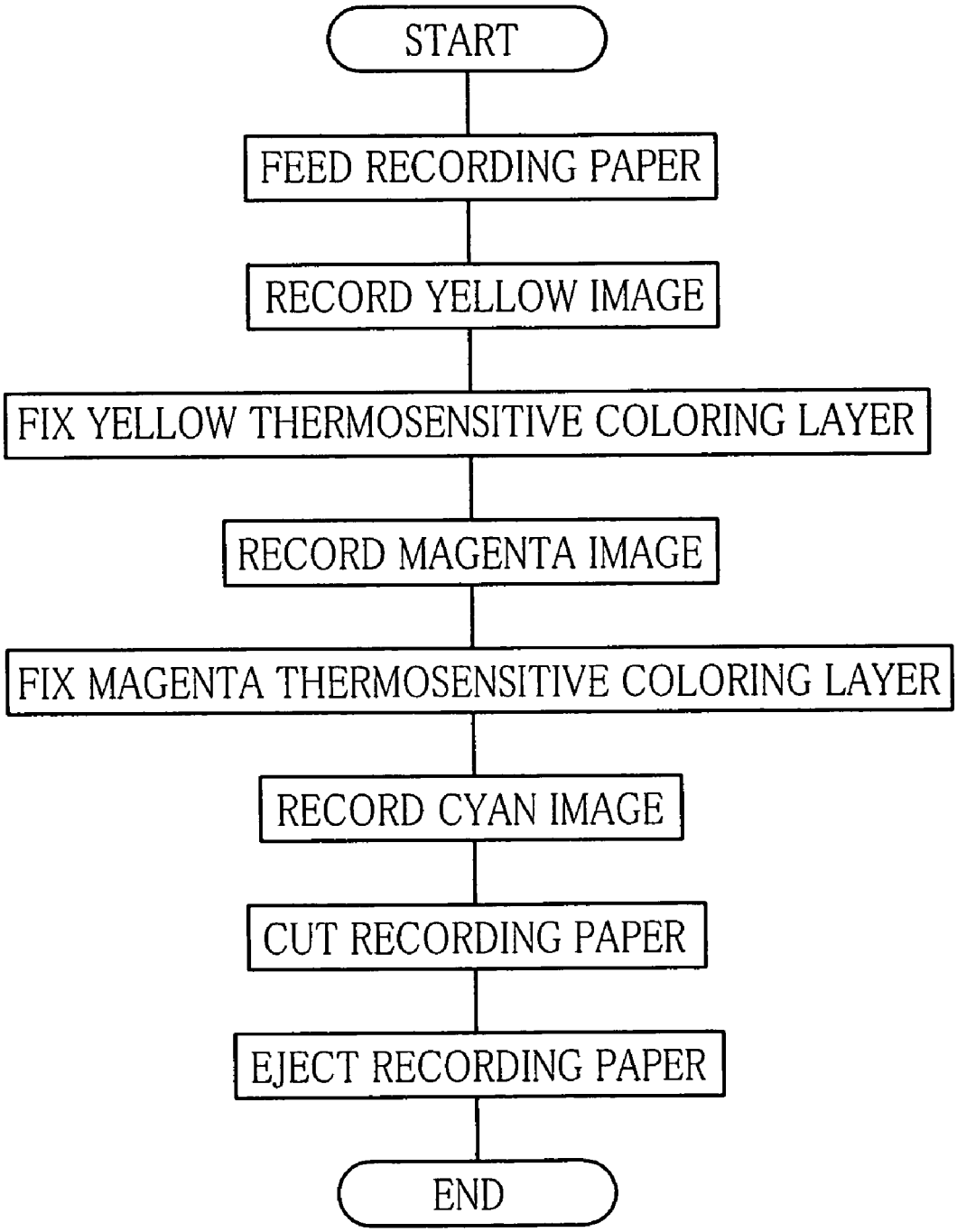
FIG. 5 is a flowchart showing procedures of thermal recording of the direct color thermal printer.

Next, referring to FIG. 5, an operation of the above embodiment is described. When a print start operation is initiated, the roller 14 is rotated in the counterclockwise direction according to the rotation of the feed motor 13 in the clockwise direction, so that the color thermosensitive recording paper 3 is advanced from the recording paper roll 4 toward the feeding direction. When the front end of the color thermosensitive recording paper 3 moves along the feeding passage and is detected by the optical sensor 47, the rotation of the feed motor 13 is temporarily stopped. Thereafter, the pulses, which are supplied to the feed motor 13, is counted, and according to the counted value, the feeding position detecting section 53*a* detects the feeding position of the color thermosensitive recording paper 3 in the feeding passage.

The system controller 53 controls the shifting mechanism to lift the platen rollers 24, 30 and 33, so as to interpose the color thermosensitive recording paper 3 between the platen rollers 24,30 and 33, and the corresponding heating element arrays 23*b*, 29*b* and 32*b*, of the recording sections 18-20 respectively.

The thermal head 23 for yellow heats each heating element according to the drive data for the yellow image, which is input to the head driver 38, and one line of the yellow image is printed on the yellow thermosensitive coloring layer 9 of the color thermosensitive recording paper 3. The feed motor 13 resumes the rotation in the clockwise direction and feeds the color thermosensitive recording paper 3 in the feeding direction by one line. By repeating the above process, the yellow image is printed in the recording area of one frame of the color thermosensitive recording paper 3. Concurrently with the printing of the yellow image, the lamp driver 43 for yellow illuminates the fixing lamp 25 for yellow to fix the yellow thermosensitive coloring layer 9.

Through the magenta recording section 19 and the cyan recording section 20, the magenta image and the cyan image are printed in the recording area of the color thermosensitive recording paper 3 in the same way as the yellow recording section 18. The magenta thermosensitive coloring layer 8 is fixed by the fixing lamp 35 for magenta. The recording area in which the yellow, magenta, and cyan images are thermally recorded, is cut off by the cutter 49, and ejected from the printer through an ejection slot 58 as the color print in sheet form. Thus, the color prints are printed sheet by sheet sequentially. When the printing is completed, the recording paper roll 4 is rotated in a reverse direction and rewinds the color thermosensitive recording paper 3.

Figure 6:
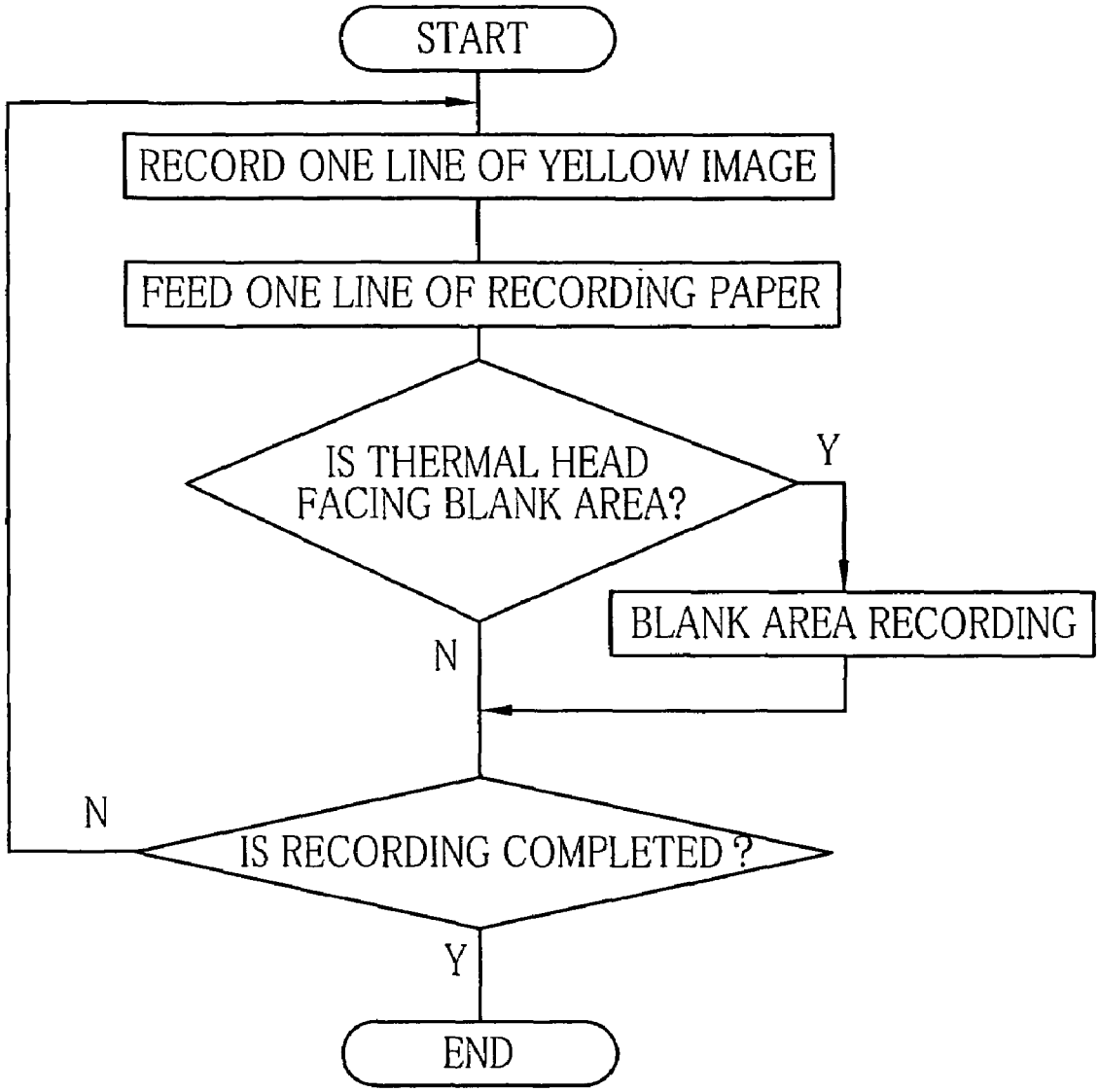
FIG. 6 is a flowchart showing procedures of the thermal recording of a yellow image.

When printing more than three color prints sequentially, one or two thermal heads may face any of the blank areas, for instance, the heating element array 23*b* of the thermal head 23 for yellow facing the blank area 3*e* as shown in FIG. 4. The feeding position detecting section 53*a* of the system controller 53 detects the respective positions of the recording areas and the blank areas of the color thermosensitive recording paper 3 in the feeding passage according to the number of pulses to the feed motor 13 and the detection timing of the optical sensor 47. As shown in a flowchart of FIG. 6, when the thermal head faces the blank area, the system controller 53 allows the thermal head to perform the blank area recording.

Figure 7:
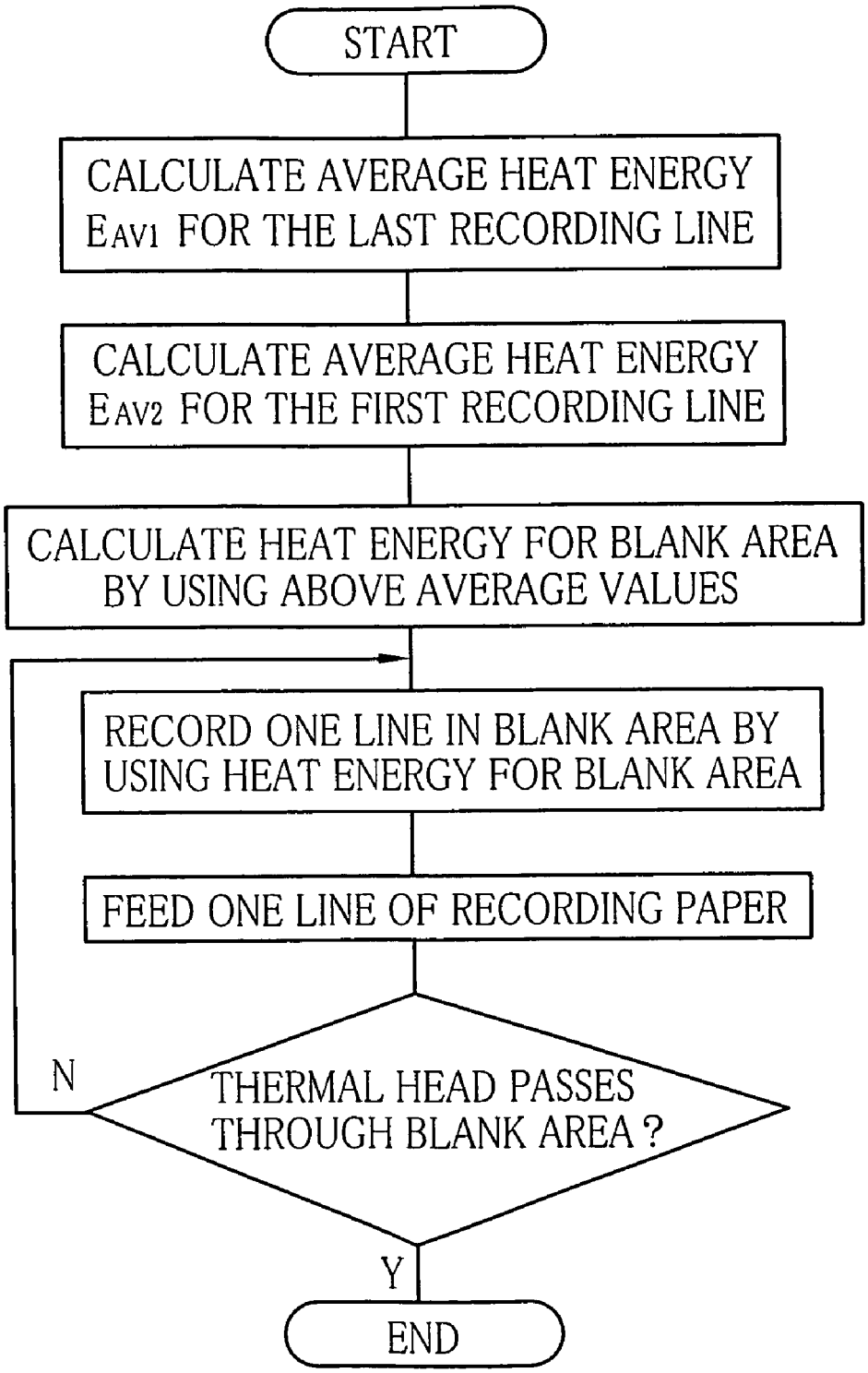
FIG. 7 is a flowchart showing procedures of blank area recording.
Figure 8:
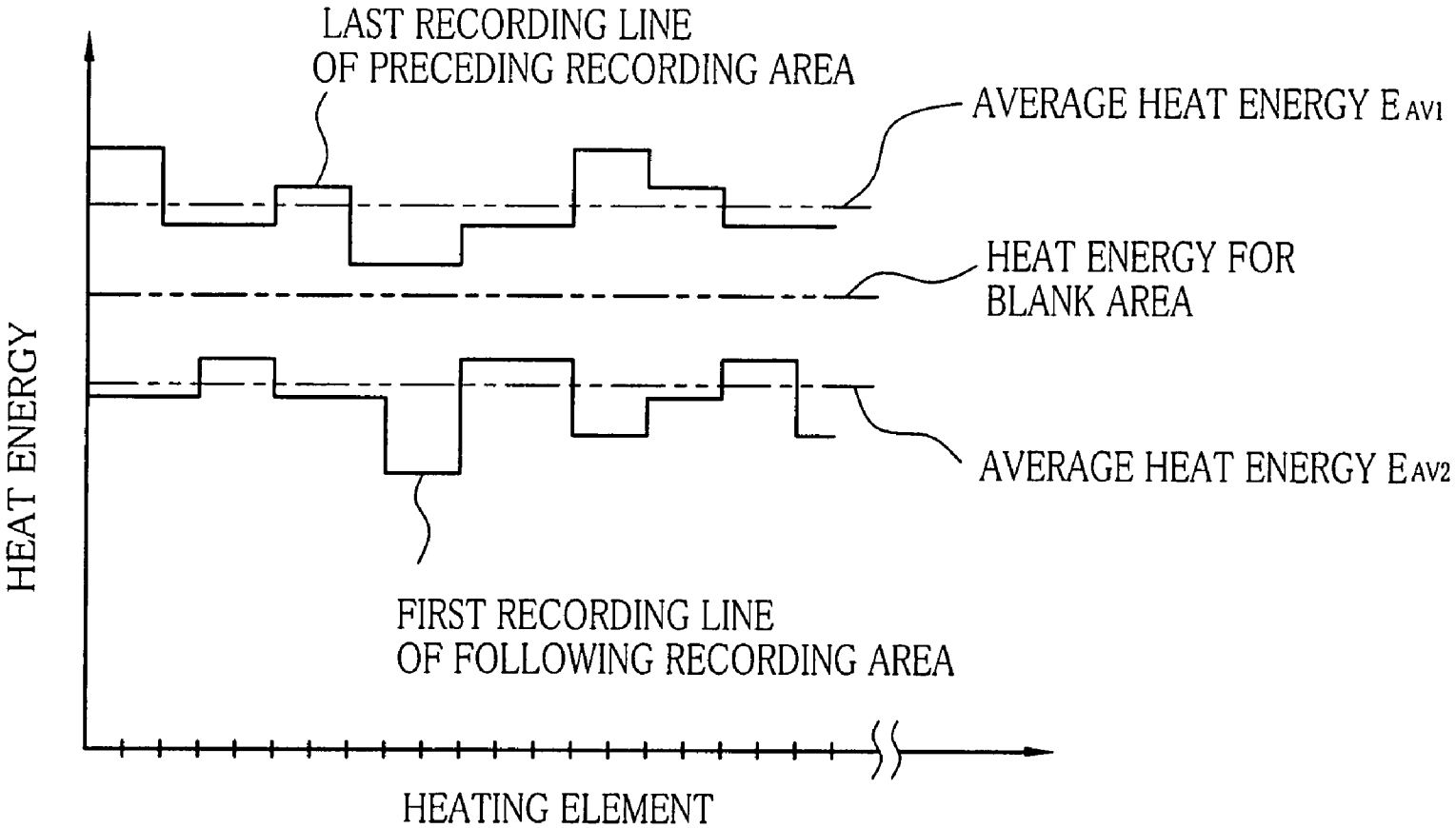
FIG. 8 is a graph showing an example of calculating heat energy for the blank area.

FIG. 7 is a flowchart showing an example of the blank area recording. The heat energy calculating section 53*b* of the system controller 53 calculates an average heat energy $E_{AV1}$ of the heat energy for recording the last recording line 3*f* in the preceding recording area 3*b* which is adjacent to the blank area 3*e* on the downstream side of the feeding direction. Further, at the same time, an average heat energy $E_{AV2}$ is calculated from the heat energy for recording the first recording line 3*g* in the following recording area 3*c* which is adjacent to the blank area 3*e* on the upstream side of the feeding direction. Then, an average of the average heat energy $E_{AV1}$ and $E_{AV2}$ is calculated (see FIG. 8) to obtain the heat energy for the blank area, and the thermal recording is performed in the blank area 3*e* line by line at the heat energy for the blank area.

Thereby, the thermal head 23 for yellow facing the blank area 3*e* continues the gradation heating, so that the load fluctuation does not occur in the power source circuit 55. As a result, the unevenness in density is not caused in the printed image. After passing through the blank area 3*e*, the thermal head 23 for yellow thermally records the yellow image on a first recording line 3*g* of the following recording area 3*c*. By the time of the thermal recording, a temperature of the heating element array 23*b* of the thermal head 23 for yellow exceeds a predetermined temperature by the blank area recording, so that conventional preheating is not necessary. Thereby, the thermal recording can be started immediately. Thus, printing time is reduced.

Further, the above blank area recording can be performed by the thermal head 29 for magenta or the thermal head 32 for cyan in the same way as the thermal head 23 for yellow when the thermal head 29 for magenta or the thermal head 32 for cyan faces the blank area. Therefore, even if the thermal head 29 for magenta or the thermal head 32 for cyan faces the blank area, the unevenness in density is not caused in the printed image, since the load fluctuations of the power source circuit 55 do not occur.

In the above embodiment, the heat energy, which is the average value of the average heat energy $E_{AV1}$ at the last recording line 3*f* in the preceding recording area 3*b* and the average heat energy $E_{AV2}$ at the first recording line 3*g* in the following recording area 3*c*, is used for recording the blank area 3*e*; however, the heat energy for the blank area recording does not necessarily become the average value. It is also possible for the heat energy to range between the calculated average heat energy $E_{AV1}$ and $E_{AV2}$, for recording the blank area 3*e*.

Figure 9:
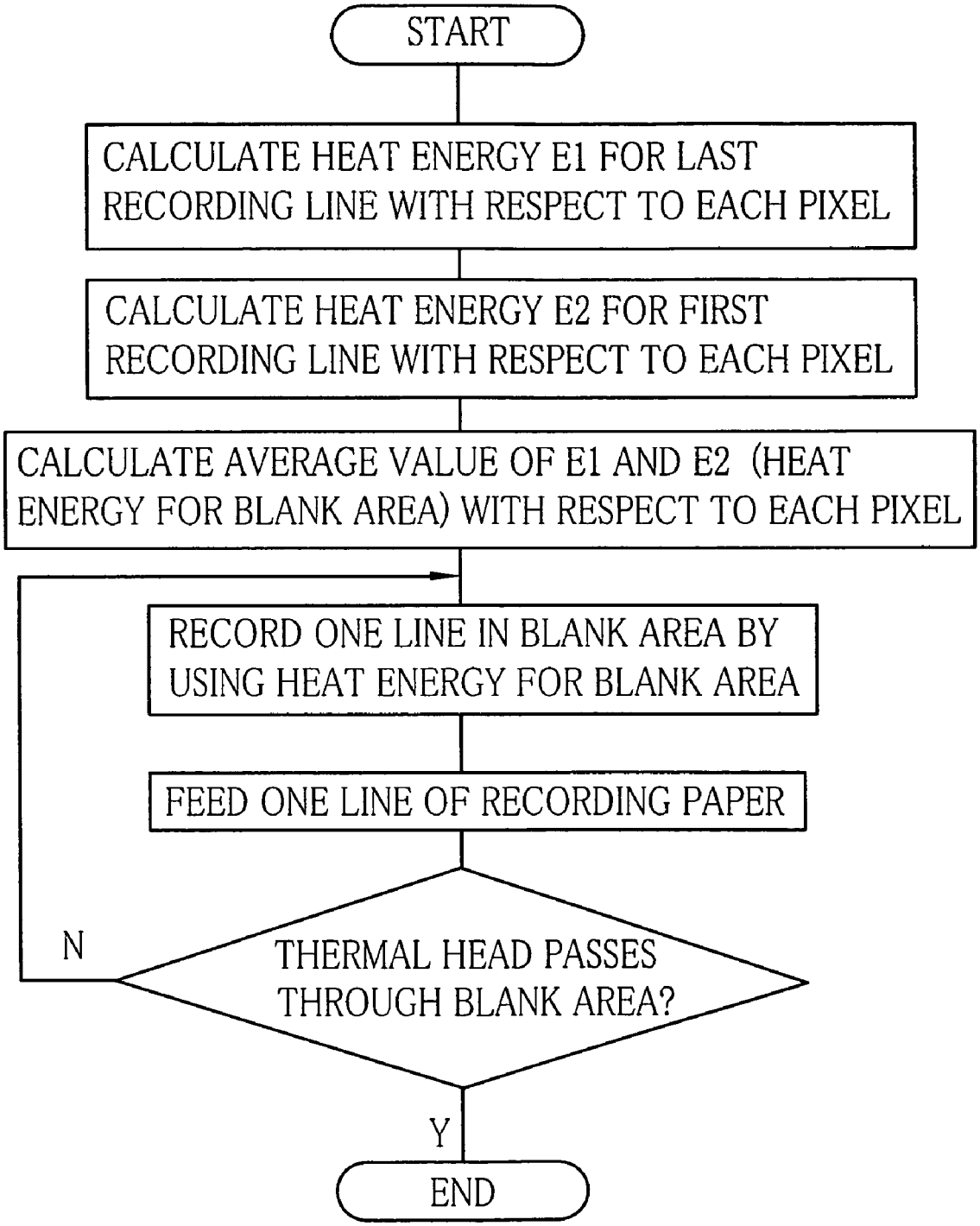
FIG. 9 is a flowchart showing procedures of the blank area recording of another embodiment.
Figure 10:
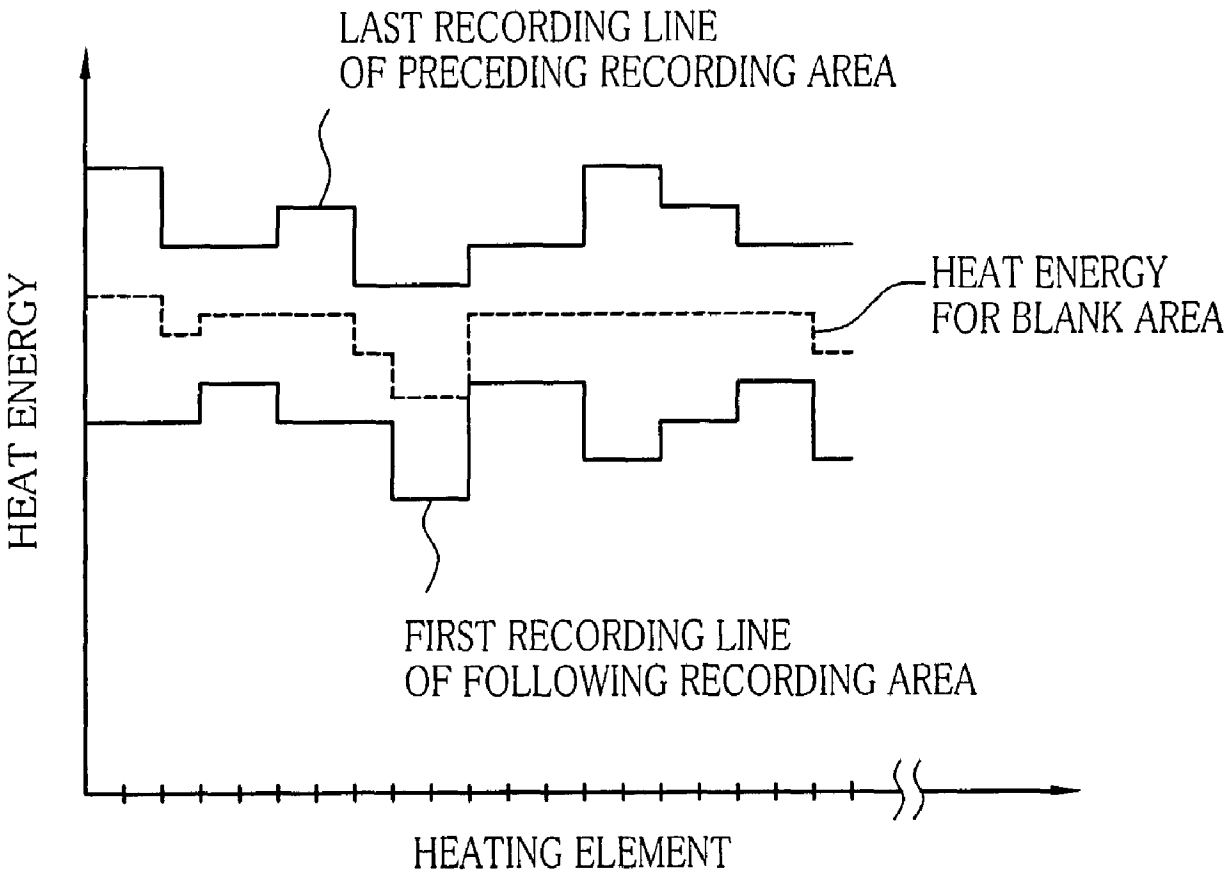
FIG. 10 is a graph showing an example of calculating heat energy for the blank area of another embodiment.

In the above embodiment, the heat energy for the blank area takes an identical value with respect to each heating element; however, it is possible to vary the heat energy for the blank area with respect to each heating element. For instance, as shown in FIGS. 9 and 10, an average value of the heat energy E1, which is used for recording the last recording line 3*f* in the preceding recording area 3*b*, and that of the heat energy E2, which is used for recording the first recording line 3*g* in the following recording area 3*c*, is calculated with respect to each heating element. Then, the system controller 53 drives each heating element with the corresponding calculated heat energy and performs the thermal recording in the blank area 3*e*. As with the case described above, the heat energy, which is used for recording the blank area 3*e*, does not necessarily become the average value. It is possible to use the heat energy which ranges between the heat energy E1 and E2.

Figure 11:
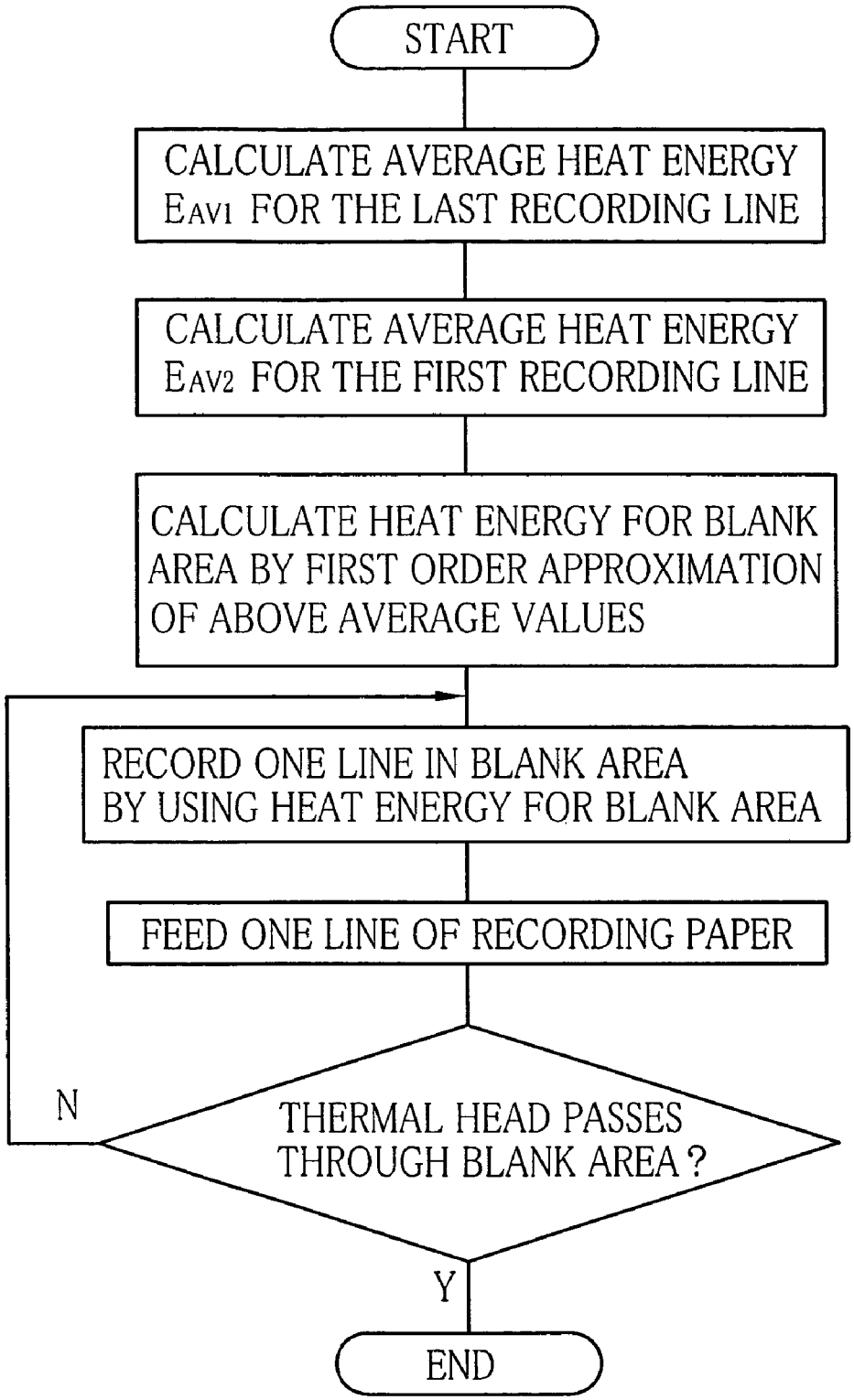
FIG. 11 is a flowchart showing procedures of the blank area recording of still another embodiment.

In the above embodiment, each heating element records each line in the blank area with the constant heat energy; however, it is also possible to control the heat energy of each heating element with respect to each line so as to gradually change the heat energy from that for the last recording line 3*f* in the preceding recording area 3*b* to that for the first recording line 3*g* in the following recording area 3*c*. For instance, as shown in FIG. 11, the average heat energy $E_{AV1}$ at the last recording line 3*f* in the preceding recording area 3*b* and the average heat energy $E_{AV2}$ at the first recording line 3*g* in the following recording area 3*c* are calculated respectively. Then a value obtained by the primary approximation of the average heat energy $E_{AV1}$ and the average heat energy $E_{AV2}$ at a recording line to be recorded in the blank area, is determined as the heat energy for such recording line in the blank area.

Figure 12:
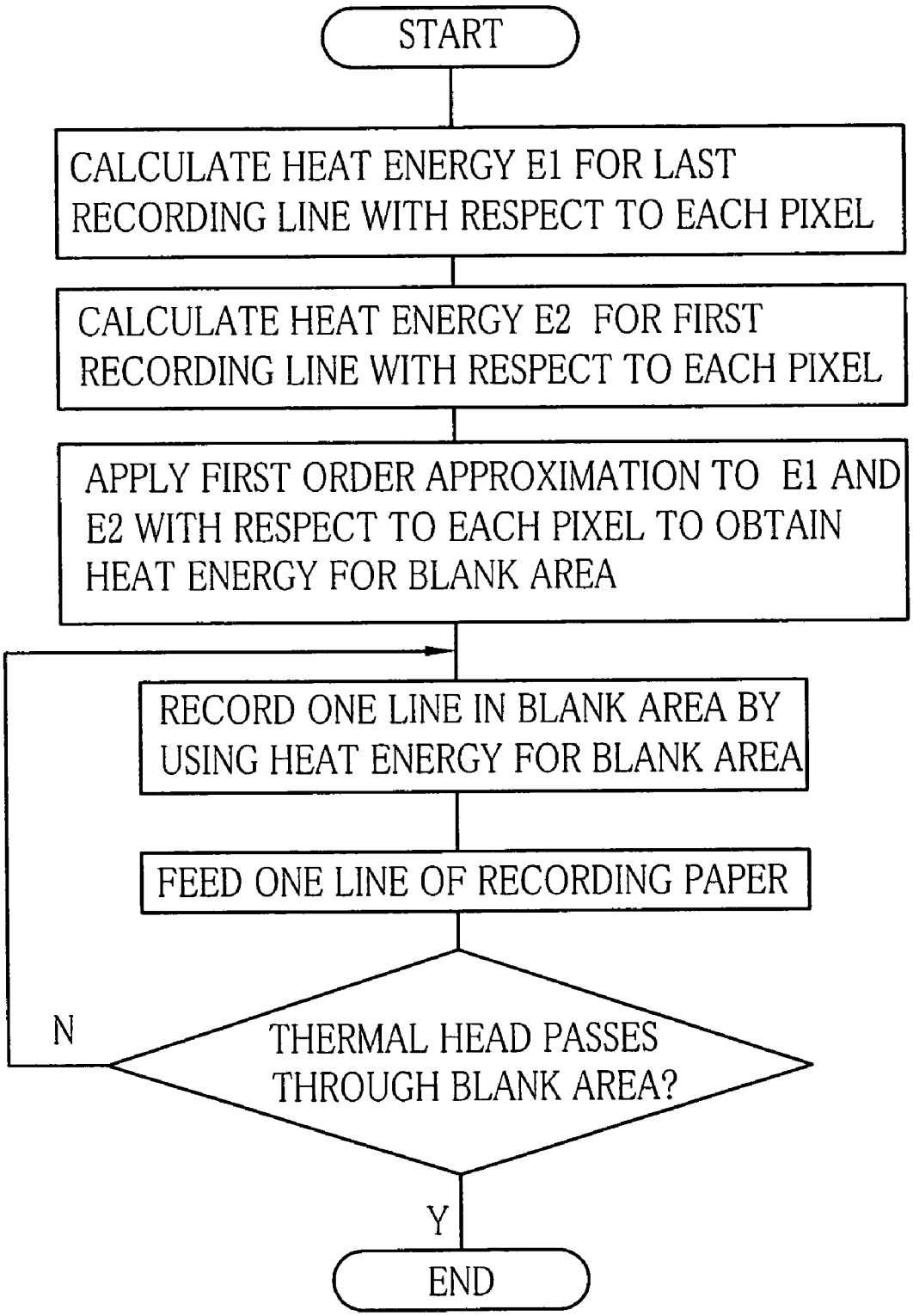
FIG. 12 is a flowchart showing procedures of the blank area recording of one other embodiment.
Figure 13:
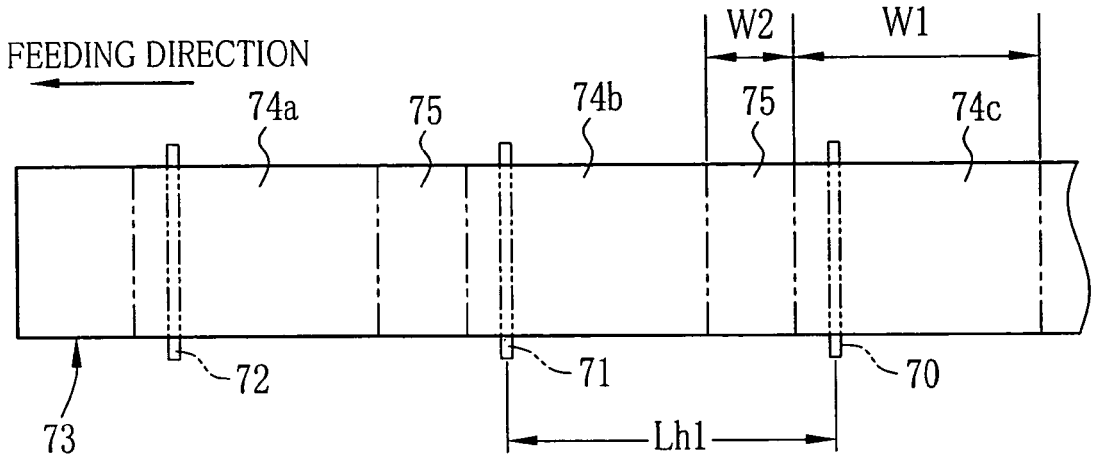
FIG. 13 (PRIOR ART)
FIG. 13 is a plan view showing a recording material of a conventional color printer.

Further, as shown in FIG. 12, the heat energy E1, which is used for recording the last recording line 3*f* in the preceding recording area 3*b*, and the heat energy E2, which is used for recording the first recording line 3*g* in the following recording area 3*c*, are calculated with respect to each heating element. Then, a value, which is obtained by the primary approximation of the heat energy E1 and the heat energy E2, is used as the heat energy for the blank area.

It becomes possible to prevent the significant load fluctuations in the power source circuit by using the heat energy obtained by the primary approximation, since the thermal head passing through the blank area 3*e* gradually changes its heat energy distribution from one needed to record the last recording line 3*f* to one needed to record the first recording line 3*g* during passing. It is also possible to calculate the heat energy, which is used for recording the blank area 3*e*, by the second order approximation or the third order approximation instead of the first order approximation.

In the above embodiment, the heat energy for the blank area is determined on the basis of the heat energy applied to the color thermosensitive recording paper 3; however, it can also be determined on the basis of energy which is provided to each print head (thermal head) or to each recording element of the print head (for instance, the electric current or the voltage to the recording element).

Further, in the above embodiment, the thermal recording is performed in the recording areas of the same size; however, the present invention can also be applied to a case where the thermal recording is performed in the recording areas of various sizes, since any of the thermal heads may also face the blank areas in the same way as described above.

Furthermore, in the above embodiment, the direct color thermal printer is described as an example. However, it is also possible to apply the present invention to thermal wax transfer printers, thermal dye sublimation printers, and ink jet printers.

Although the present invention has been described with respect to the preferred embodiment, the present invention is not to be limited to the above embodiment but, on the contrary, various modifications will be possible to those skilled in the art without departing from the scope of claims appended hereto.

What is claimed is:

1. A printing method for sequentially recording a plurality of color images on a recording material, said printing method comprising the steps of:

(a) feeding said recording material along a feeding passage, said recording material alternately forming a recording area, in which said color images are recorded, and a blank area which is placed between said recording areas adjacent to each other;

(b) recording said color images by a plurality of print heads in said recording areas facing said print heads, each of said print heads being disposed along said feeding passage in a predetermined interval, and printing in different colors by one line;

(c) detecting a position information of said blank area formed between said recording areas on said feeding passage;

(d) determining whether said blank area facing said print head or not according to said position information of said blank area;

(e) calculating a recording energy for said blank area for recording said blank area; and (f) recording said blank area by supplying said recording energy for said blank area to said print head when said blank area facing said print head.

2. A printing method as claimed in claim 1, wherein said print head includes a plurality of recording elements arranged in a width direction of said recording material, wherein said recording energy for said blank area is calculated on the basis of recording energies supplied to said recording elements upon recording said image both in a preceding recording area, which is adjacent to said blank area on a downstream side of said feeding passage, and in a following recording area, which is adjacent to said blank area on an upstream side of said feeding passage.

3. A printing method as claimed in claim 2, said step (e) further comprising the steps of:

(e1) calculating a first average recording energy, said first average recording energy being an average value of recording energy which is supplied to said recording elements when recording said image at a last recording line in said preceding recording area;

(e2) calculating a second average recording energy, said second average recording energy being an average value of recording energy which is supplied to said recording elements when recording said image at a first recording line in said following recording area; and (e3) determining a value ranging between said first average recording energy and said second average recording energy as said recording energy for said blank area.

4. A printing method as claimed in claim 3, wherein said recording energy for said blank area is an average value of said first average recording energy and said second average recording energy.

5. A printing method as claimed in claim 3, wherein said recording energy for said blank area is gradually increased or decreased from said first average recording energy to said second average recording energy.

6. A printing method as claimed in claim 5, wherein said recording energy for said blank area is calculated with the first order approximation of said first average recording energy and said second average recording energy.

7. A printing method as claimed in claim 2, wherein said recording energy for said blank area is determined with respect to each recording element of said print head, said recording energy for said blank area is a value which ranges between a first recording energy for recording said image at a last recording line in said preceding recording area by said recording element, and a second recording energy for recording said image at a first recording line of said following recording area by said recording element.

8. A printing method as claimed in claim 7, wherein said recording energy for said blank area is an average value of said first recording energy and said second recording energy.

9. A printing method as claimed in claim 7, wherein said recording energy for said blank area is gradually increased or decreased from said first recording energy to said second recording energy.

10. A printing method as claimed in claim 9, wherein said recording energy for said blank area is calculated with the first order approximation of said first recording energy and said second recording energy.

11. A printing method as claimed in claim 2, wherein each interval between said print heads is shorter than a sum of lengths of said recording area and said blank area along said feeding passage.

12. A printing method as claimed in claim 11, wherein said print head is a thermal head.

13. A printer for recording color images in a recording area while feeding a recording material, which alternately forms said recording area and a blank area, along a feeding passage from an upstream side to a down stream side, said printer comprising:

a plurality of print heads being arranged along said feeding passage, each of said print heads recording said recording area in different colors by one line;

a feeding position detection device for detecting a position of said blank area on said feeding passage;

a recording energy calculation device for calculating a recording energy for said blank area for recording said blank area; and a print head driver for driving said print head, said print head driver supplying said recording energy for said blank area to said print head when said blank area facing said print head, and supplying recording energy according to density of said color image to said print head when said recording area facing said print head.

14. A printer as claimed in claim 13, wherein said print head includes a plurality of recording elements arranged in a width direction of said recording material;

wherein said recording energy for said blank area is calculated according to recording energies supplied to said recording elements when said image is recorded both in a preceding recording area, which is adjacent to said blank area on said downstream side of said feeding passage, and in a following recording area which is adjacent to said blank area on said upstream side of said feeding passage.

15. A printer as claimed in claim 14, wherein said recording energy for said blank area is determined as a value ranging between a first average recording energy, which is an average value of recording energy supplied to said recording elements for recording said image at a last recording line in said preceding recording area, and a second average recording energy, which is an average value of recording energy supplied to said recording elements for recording said image at a first recording line in said following recording area.

16. A printer as claimed in claim 15, wherein said recording energy for said blank area is an average value of said first average recording energy and said second average recording energy.

17. A printer as claimed in claim 15, wherein said recording energy for said blank area is gradually increased or decreased from said first average recording energy to said second average recording energy.

18. A printer as claimed in claim 17, wherein said recording energy for said blank area is calculated with the first order approximation of said first average recording energy and said second average recording energy.

19. A printer as claimed in claim 14, wherein said recording energy for said blank area is determined with respect to each recording element of said print head, said recording energy for said blank area is a value which ranges between a first recording energy for recording said image at a last recording line in said preceding recording area by said recording element, and a second recording energy for recording said image at a first recording line in said following recording area by said recording element.

20. A printer as claimed in claim 19, wherein said recording energy for said blank area is an average value of said first recording energy and said second recording energy.

21. A printer as claimed in claim 19, wherein said recording energy for said blank area is gradually increased or decreased from said first recording energy to said second recording energy.

22. A printer as claimed in claim 21, wherein said recording energy for said blank area is calculated with the first order approximation of said first recording energy and said second recording energy.

23. A printer as claimed in claim 13, wherein each interval between said print heads is shorter than a sum of lengths of said recording area and said blank area along said feeding passage.

24. A printer as claimed in claim 23, wherein said print head is a thermal head.

* * * * *